US007097776B2

(12) United States Patent
Govinda Raju

(10) Patent No.: US 7,097,776 B2
(45) Date of Patent: Aug. 29, 2006

(54) METHOD OF FABRICATING MICRONEEDLES

(75) Inventor: Ramesh Govinda Raju, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 122 days.

(21) Appl. No.: 10/972,196

(22) Filed: Oct. 22, 2004

(65) Prior Publication Data

US 2006/0086689 A1 Apr. 27, 2006

(51) Int. Cl.
*B44C 1/22* (2006.01)
*C23F 1/00* (2006.01)

(52) U.S. Cl. ..... 216/11; 216/2; 216/41; 216/74; 427/430.1; 205/80

(58) Field of Classification Search ..... 216/2, 216/11, 41, 74, 83; 427/430.1; 205/80
See application file for complete search history.

(56) References Cited

U.S. PATENT DOCUMENTS 6,334,856 B1 1/2002 Allen
6,749,792 B1 * 6/2004 Olson ..... 264/328.1
6,875,613 B1 * 4/2005 Shartle et al. ..... 436/63
2002/0155737 A1 10/2002 Shuvo
2005/0011858 A1 * 1/2005 Kuo et al. ..... 216/17

* cited by examiner

*Primary Examiner*—Shamim Ahmed

(57) ABSTRACT

A low cost method for fabricating microneedles is provided. According to one embodiment, the fabrication method includes the steps of: providing a substrate; forming a metal-containing seed layer on the top surface of the substrate; forming a nonconductive pattern on a portion of the seed layer; plating a first metal on the seed layer and over the edge of the nonconductive pattern to create a micromold with an opening that exposes a portion of the nonconductive pattern, the opening having a tapered sidewall surface; plating a second metal onto the micromold to form a microneedle in the opening; separating the micromold with the microneedle formed therein from the seed layer and the nonconductive pattern; and selectively etching the micromold so as to release the microneedle.

23 Claims, 13 Drawing Sheets

METHOD OF FABRICATING MICRONEEDLES

FIELD OF THE INVENTION

The invention is generally related to microneedles and more particular to a method of fabrication thereof.

BACKGROUND OF THE INVENTION

In the medical field, hollow microneedles have been developed for delivering drugs or withdrawal of bodily fluids across biological barriers, such as skin. A microneedle is a miniature needle with a penetration depth of about 50–150 μm. The microneedle is designed to penetrate the skin but not hit the nerves. An array of microneedles may be combined with an analyte measurement system to provide a minimally invasive fluid retrieval and analyte sensing system. In other fields, solid mironeedles are desirable as probles to sense electrical signals or to apply stimulation electrical signals, and hollow microneedles are useful as means for dispensing small volume of materials.

Methods for fabricating microneedles from silicon have been proposed. However, silicon microneedles require expensive processing steps. Furthermore, silicon is highly brittle and susceptible to fracturing during penetration. Alternatively, microneedles may be made from stainless steel and other metals. However, metal microneedles are subject to several disadvantages, one of which is the manufacturing complexities involved in metal processing steps such as grinding, deburring and cleaning. Therefore, there exists a need for a method of fabricating metal microneedles that is relatively simple and inexpensive.

SUMMARY OF THE INVENTION

Low cost methods for fabricating microneedles are provided. A fabrication method according to one embodiment includes the steps of: providing a substrate; forming a metal-containing seed layer on the top surface of the substrate; forming a nonconductive pattern on a portion of the seed layer; plating a first metal on the seed layer and over the edge of the nonconductive pattern to create a micromold with an opening that exposes a portion of the nonconductive pattern, the opening having a tapered sidewall surface; plating a second metal onto the micromold to form a microneedle in the opening; separating the micromold with the microneedle formed therein from the seed layer and the nonconductive pattern; and selectively etching the micromold so as to release the microneedle.

Other aspects and advantages of the present invention will become apparent from the following detailed description, taken in conjunction with the accompanying drawings.

DETAILED DESCRIPTION

Figure 1:
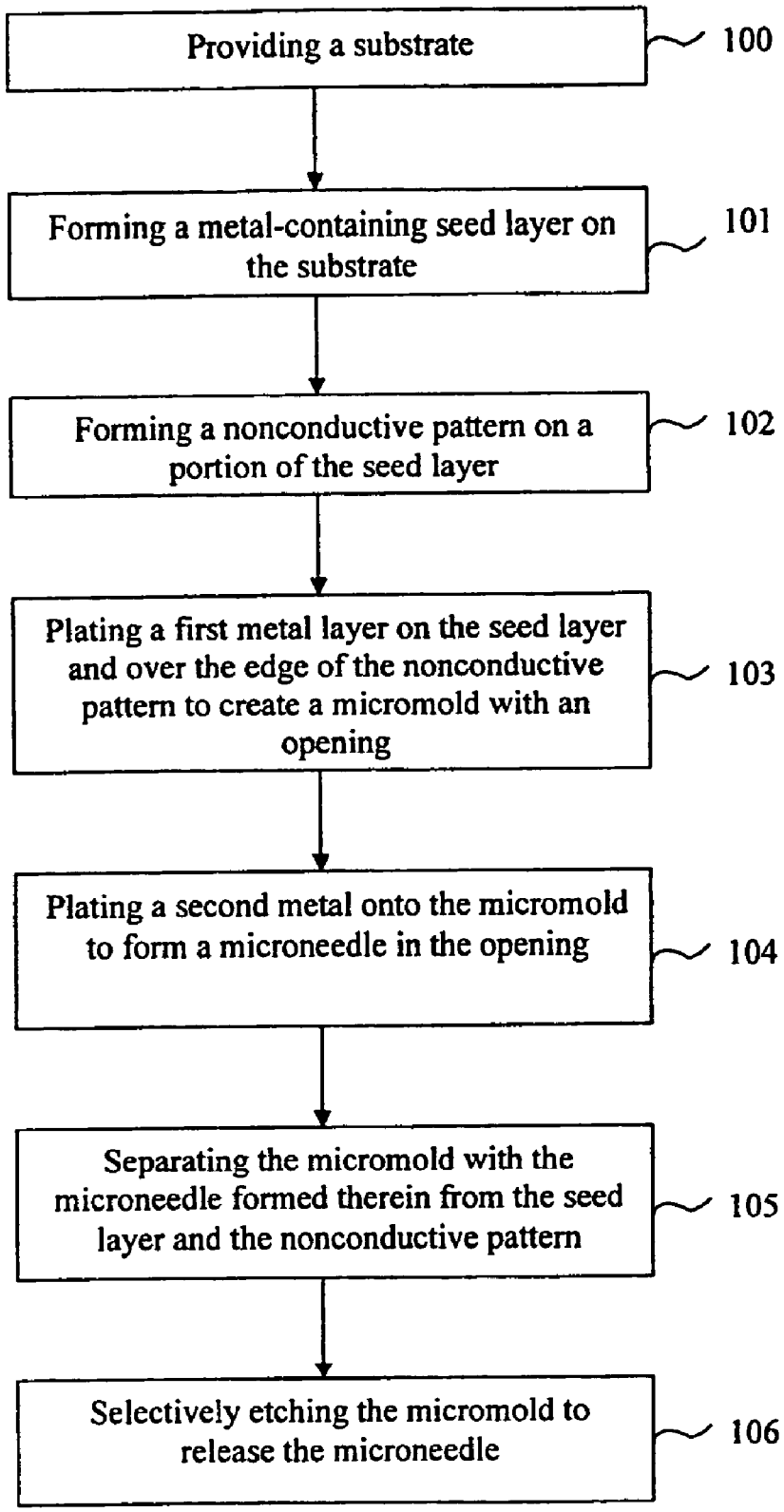
FIG. 1 is a flow chart illustrating a method for fabricating a microneedle in accordance with one embodiment of the present invention.

FIG. 1 is a flow chart illustrating a method for fabricating a microneedle in accordance with an embodiment of the present invention. In this embodiment, a substrate is provided at step 100. A metal-containing seed layer is formed on the substrate at step 101. A nonconductive pattern is formed on a portion of the seed layer at step 102. At step 103, a first metal layer is plated on the seed layer and over the edge of the nonconductive pattern to create a micromold with an opening. Next, a second metal is plated onto the micromold to form a microneedle in the opening at step 104. The micromold together with the microneedle formed therein are separated from the seed layer and the nonconductive pattern at step 105. The micromold is then selectively etched to release the microneedle at step 106.

Figure 2A:
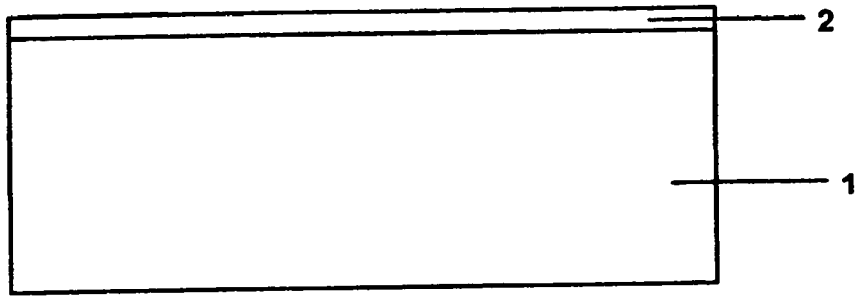
FIGS. 2A–2F show cross-sectional views illustrating the method steps of FIG. 1.

FIGS. 2A–2F show the cross-sectional views illustrating the method steps of FIG. 1. Referring to FIG. 2A, a metal-containing seed layer 2 is formed on a substrate 1. The substrate 1 can be constructed from a semiconductor material such as silicon, a nonconductive material such as glass, a metal such as stainless steel or aluminum, or a premolded plastic. The metal-containing seed layer 2 may be a thin layer of chrome, stainless steel, tantalum or gold, which is formed by sputtering or other conventional deposition techniques. The seed layer 2 may also be a bilayer of chrome/stainless steel (chrome being the lower layer) or tantalum/gold (tantalum being the lower layer). The thickness for the seed layer may be between about 500 angstroms to about 20000 angstroms.

Figure 2B:
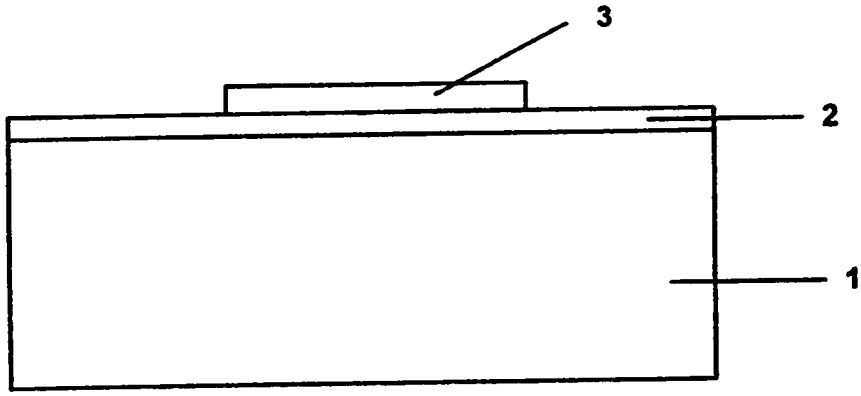

Next, a nonconductive layer is deposited on the seed layer 2 and patterned to produce a nonconductive pattern 3 as shown in FIG. 2B. The patterning of the nonconductive layer may be done by forming a photolithographic mask on the nonconductive layer followed by etching. Suitable materials for the nonconductive pattern 3 include silicon carbide, photoresist, silicon nitride, silicon oxide. The thickness for the nonconductive pattern may be between about 500 angstroms to about 50000 angstroms.

Figure 2C:
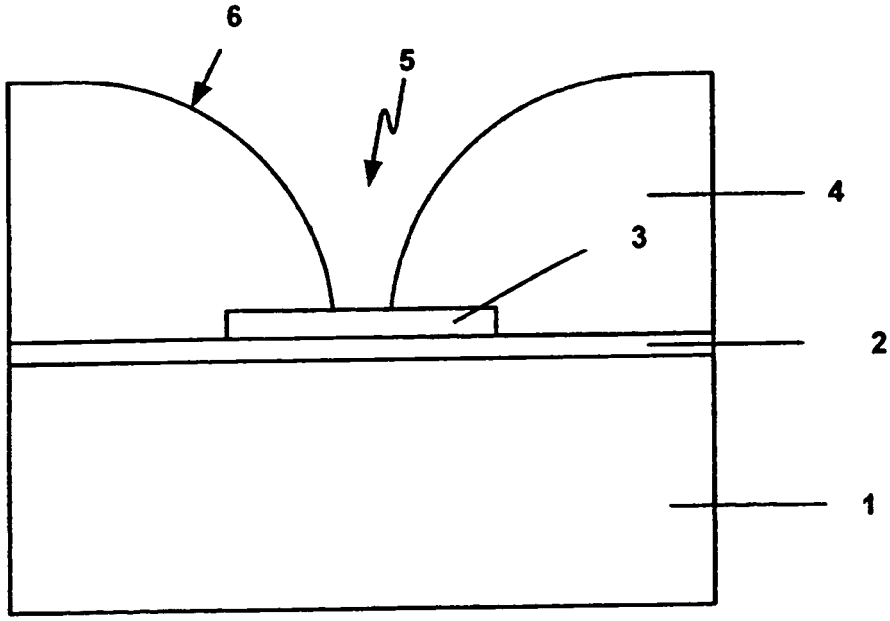

Referring to FIG. 2C, a first metal is plated onto the seed layer 2 and over the edge of the nonconductive pattern 3 so as to form a micromold 4 with an opening 5 that exposes a portion of the nonconductive pattern 3. The plating step may be done by electroplating, which can be controlled to generate an opening with a rounded and tapered sidewall 6 as shown in FIG. 2C. The first metal may be plated to a thickness between about 1 μm to 4 mm. The bottom of the opening 5, which defines the contour for the microneedle's tip to be formed, may have a diameter in the order of 5 um to 100 μm. The micromold 4 may be constructed of any metal that can be electroplated with good uniformity during plating and can be selectively etched away with respect to other metals. Suitable metals include nickel, tin, tin-lead all, aluminium and aluminum alloys.

Figure 2D:
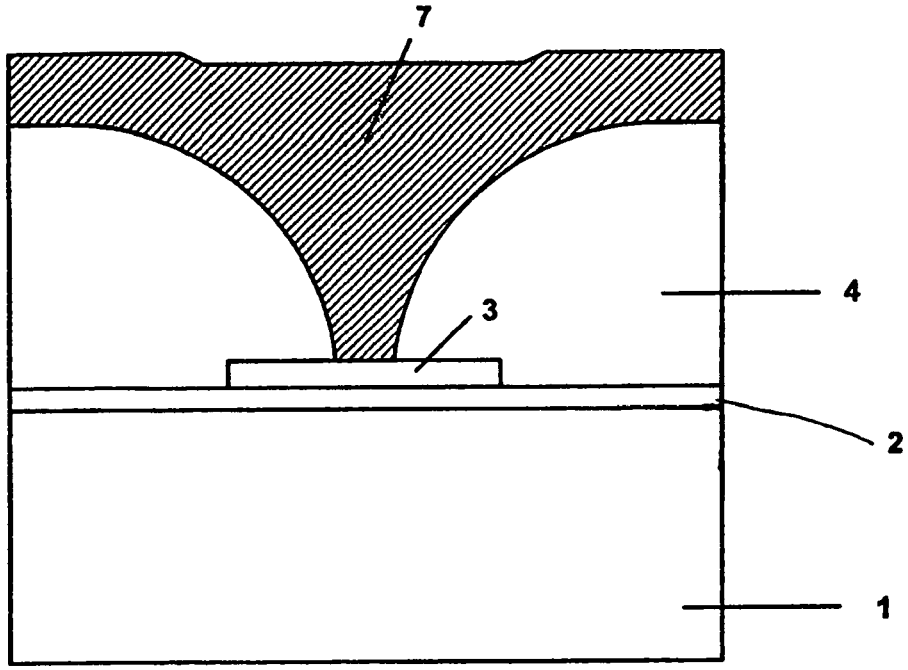
Figure 2D:
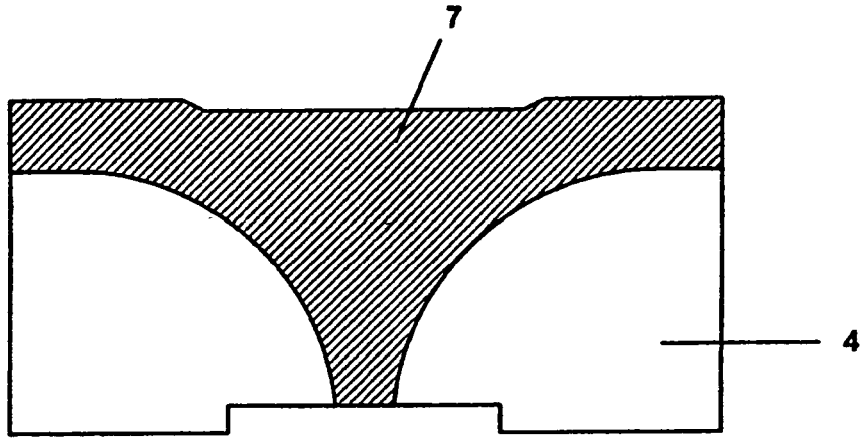

Referring to FIG. 2D, a second metal is plated onto the micromold 4 so as to completely fill the opening 5 and form a microneedle 7. The second metal used to form the microneedle 7 should be different from the first metal used for the micromold 4. The microneedle may be constructed of a variety of metals depending on the intended use. For medical applications, the metal microneedle 7 may be made of palladium, silver, gold, nickel, brass, bronze, or alloys thereof. The properties of the second metal that are required for most applications include mechanical strength, biocompatibility, ability to be easily and uniformly electroplated into thick films, chemical stability (e.g. corrosion resistance), and ability to be selectively etched away from the first metal. For example, nickel may be used for forming the micromold and silver may be used for forming the microneedle because palladium can be selectively etched from nickel using a solution nitric acid and hydrogen peroxide and it has high mechanical strength and is biocompatible and can be plated to a relatively thick film.

Figure 2E:
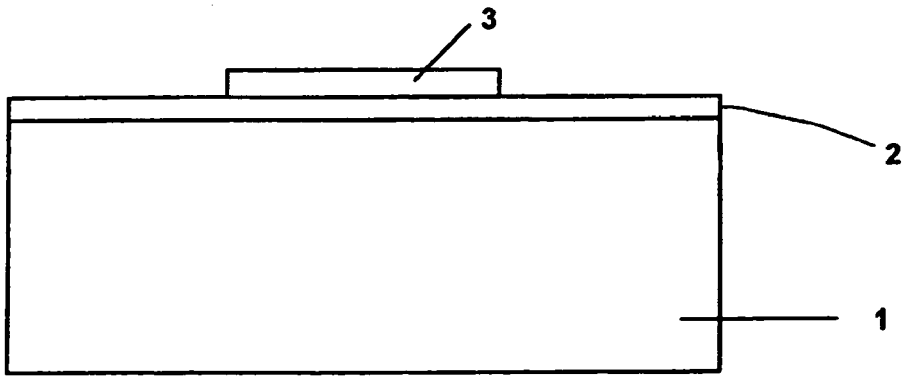

Referring to FIG. 2E, the micromold 4 together with the microneedle 7 are separated from the seed layer 2 and the nonconductive pattern 3. The separation may be done by peeling away the micromold 4 with the microneedle 7 formed therein. Alternatively, separation may be done with the aid of ultrasonic agitation. The whole structure is placed into a bath and ultrasonic energy is applied to induce mechanical vibration, thereby causing the separation.

Figure 2F:
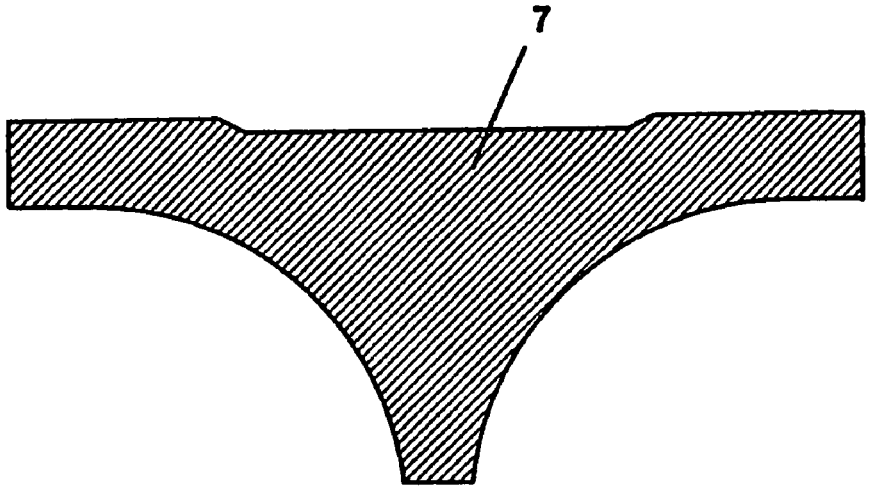

Next, the micromold 4 is selectively etched to release the microneedle 7 as shown in FIG. 2F. If nickel is used to form the micromold 4, the nickel micromold may be selectively etched away using a solution of nitric acid and hydrogen peroxide.

The substrate 1 with the seed layer 2 and the nonconductive pattern 3 formed thereon (FIG. 2B) is a reusable structure upon which additional microneedles may be formed by repeating the plating steps.

Figure 3:
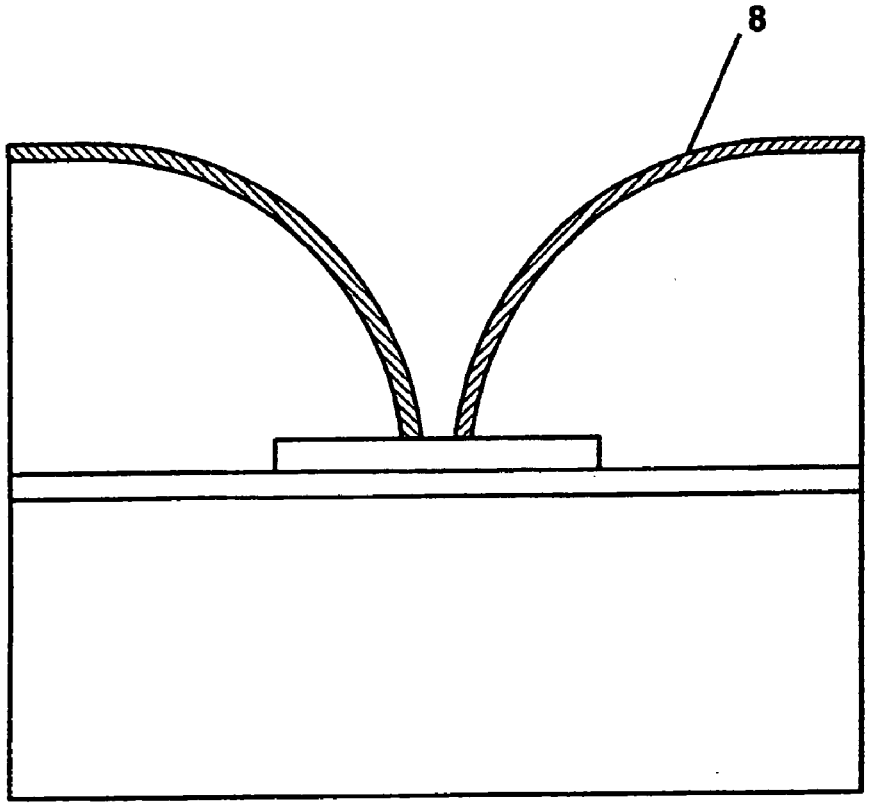
FIG. 3 shows the cross-sectional view of a hollow microneedle being formed in accordance with another embodiment of the present invention.

FIG. 2D shows that the second metal completely fills the opening 5 in the micromold 4 to form a solid microneedle 7. However, in another embodiment shown in FIG. 3, the plating thickness of the second metal is controlled so as to form a plated coating on the sidewall of the opening 5, thereby forming a hollow microneedle 8. The second metal may be plated to a thickness in the range from about 5 μm to about 500 μm. Such hollow microneedles are useful for drug injection and extraction of bodily fluids.

Figure 4:
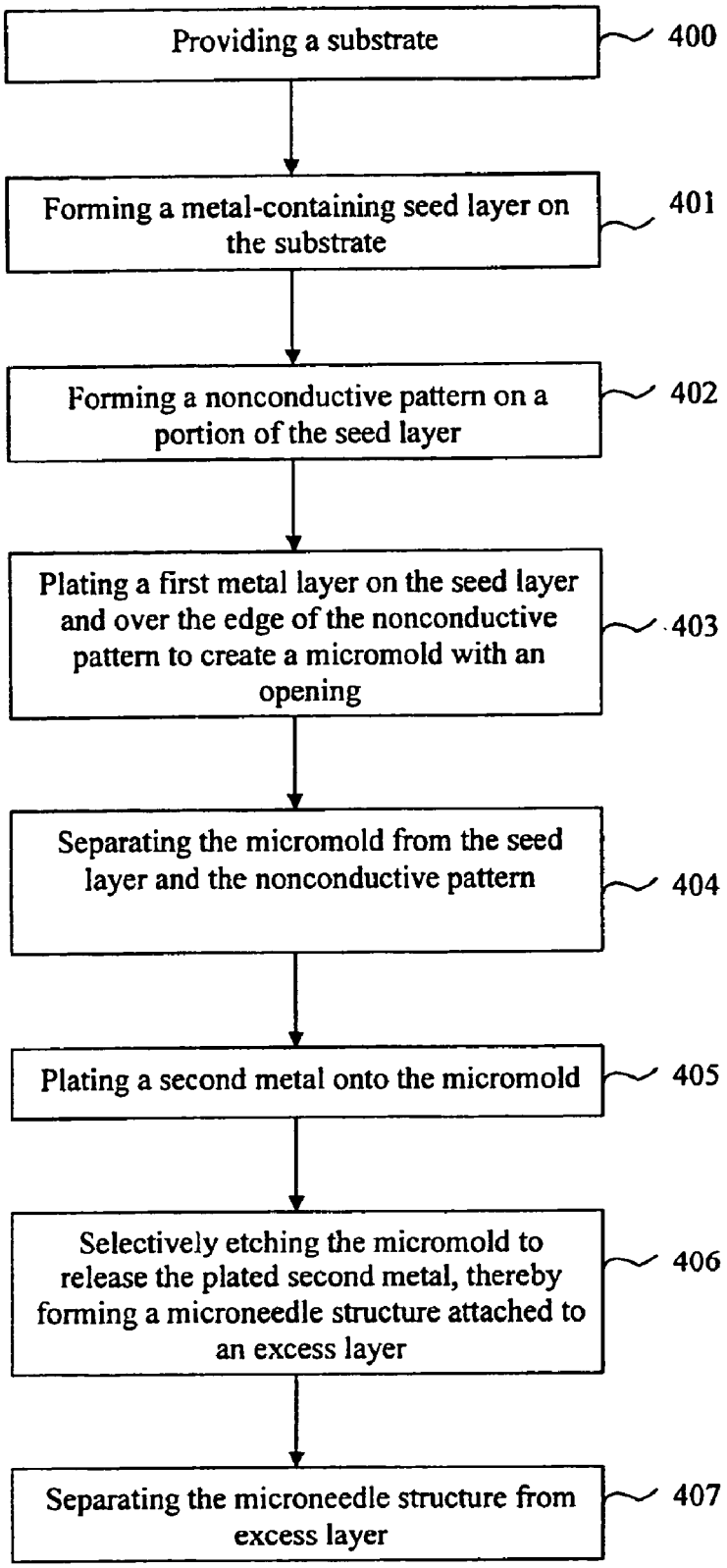
FIG. 4 is a flow chart illustrating a method for fabricating a microneedle in accordance with a third embodiment of the present invention.

FIG. 4 is a flow chart illustrating a method for fabricating a microneedle in accordance with a third embodiment of the present invention. In this embodiment, a substrate is provided at step 400. A metal-containing seed layer is formed on the substrate at step 401. A nonconductive pattern is formed on a portion of the seed layer at step 402. At step 403, a first metal layer is plated on the seed layer and over the edge of the nonconductive pattern to create a micromold with an opening. The micromold is separated from the seed layer and the nonconductive pattern at step 404. At step 405, a second metal is plated onto the micromold, thereby filling the opening and coating the exposed top and bottom surfaces of the micromold with the second metal. The micromold is selectively etched to release the plated second metal at step 406. The plated second metal from step 406 has the configuration of a microneedle structure attached to an excess layer. The microneedle structure is then separated from the excess layer in step 407.

Figure 5A:
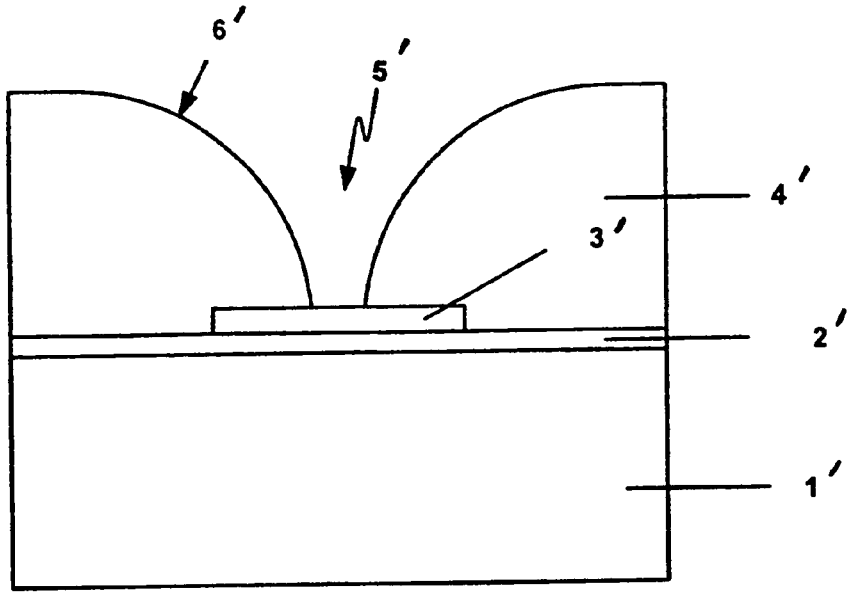
FIGS. 5A–5E show cross-sectional views illustrating the method steps of FIG. 4.
Figure 5B:
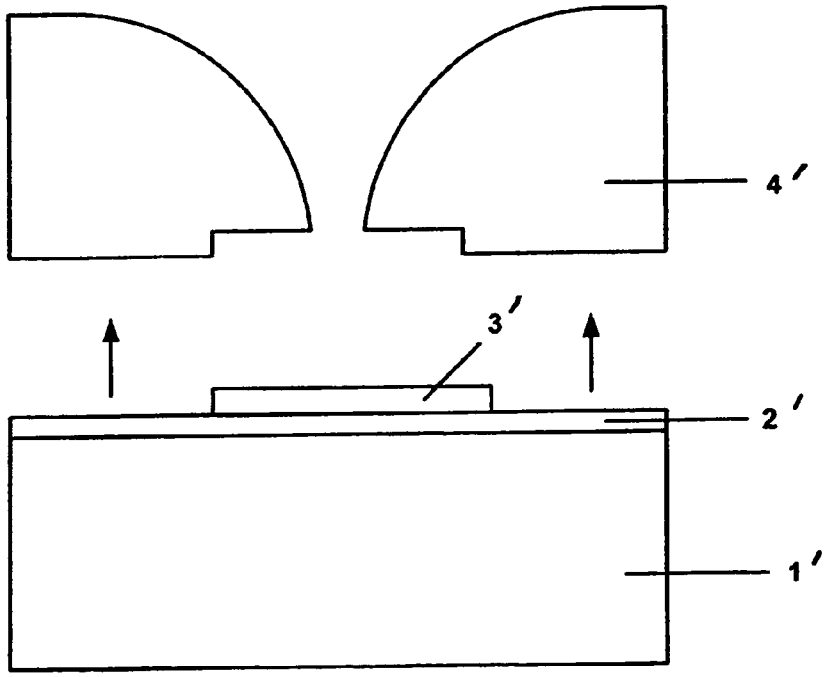
Figure 5C:
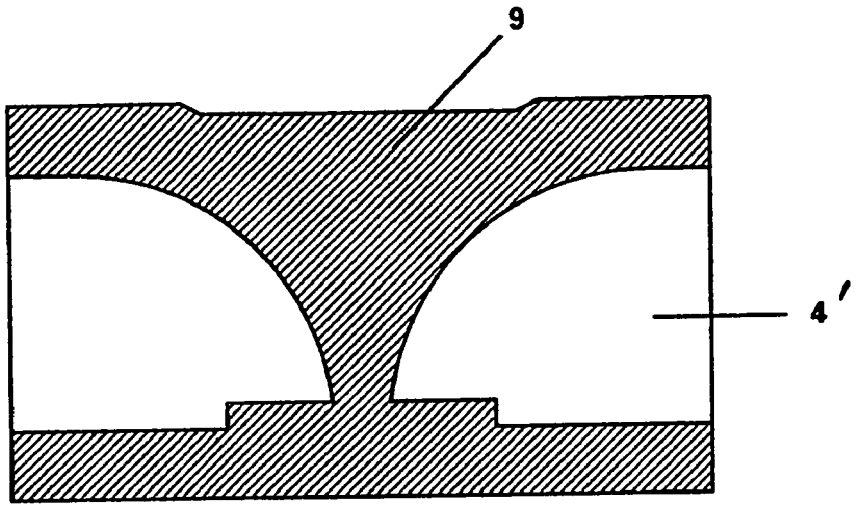
Figure 5D:
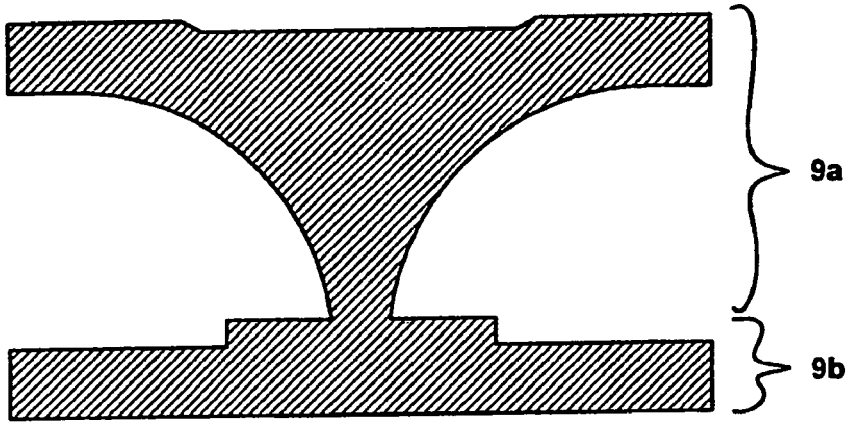
Figure 5E:
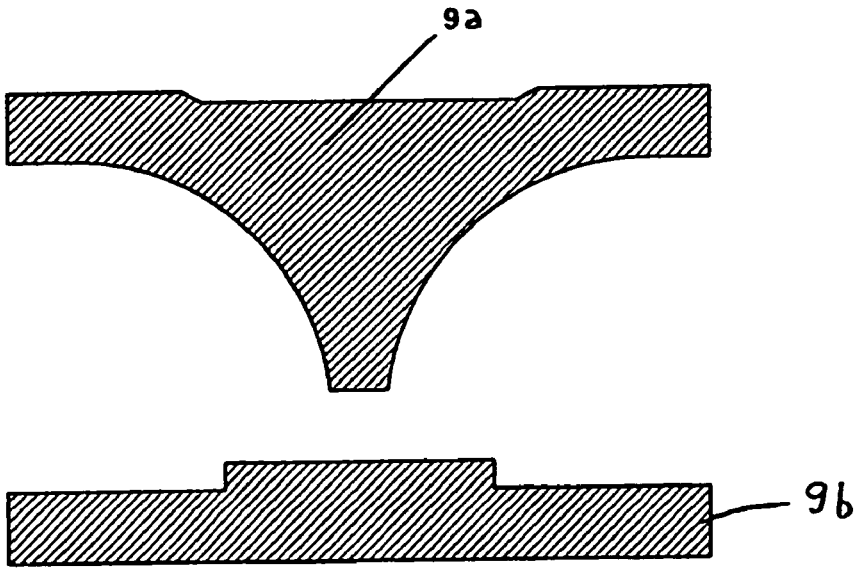

FIGS. 5A–5E show the cross-sectional views illustrating the method steps of FIG. 4. Referring to FIG. 5A, a micromold 4' having an opening 5' is formed on a reusable structure composed of substrate 1', seed layer 2' and the nonconductive pattern 3'. The micromold 4' is then separated from the reusable structure as shown in FIG. 5B. The separated micromold 4' is next placed in a plating station and plating is carried out to fill the opening 5' and cover the upper and lover surfaces of the micromold with a second metal 9 as shown in FIG. 5C. The micromold 4' is then etched away leaving a microneedle structure 9*a* attached to an excess layer 9*b* as shown in FIG. 5D. Referring to FIG. 5E, the excess layer 9*b* is separated from the microneedle structure 9*a* by mechanical means.

Figure 6:
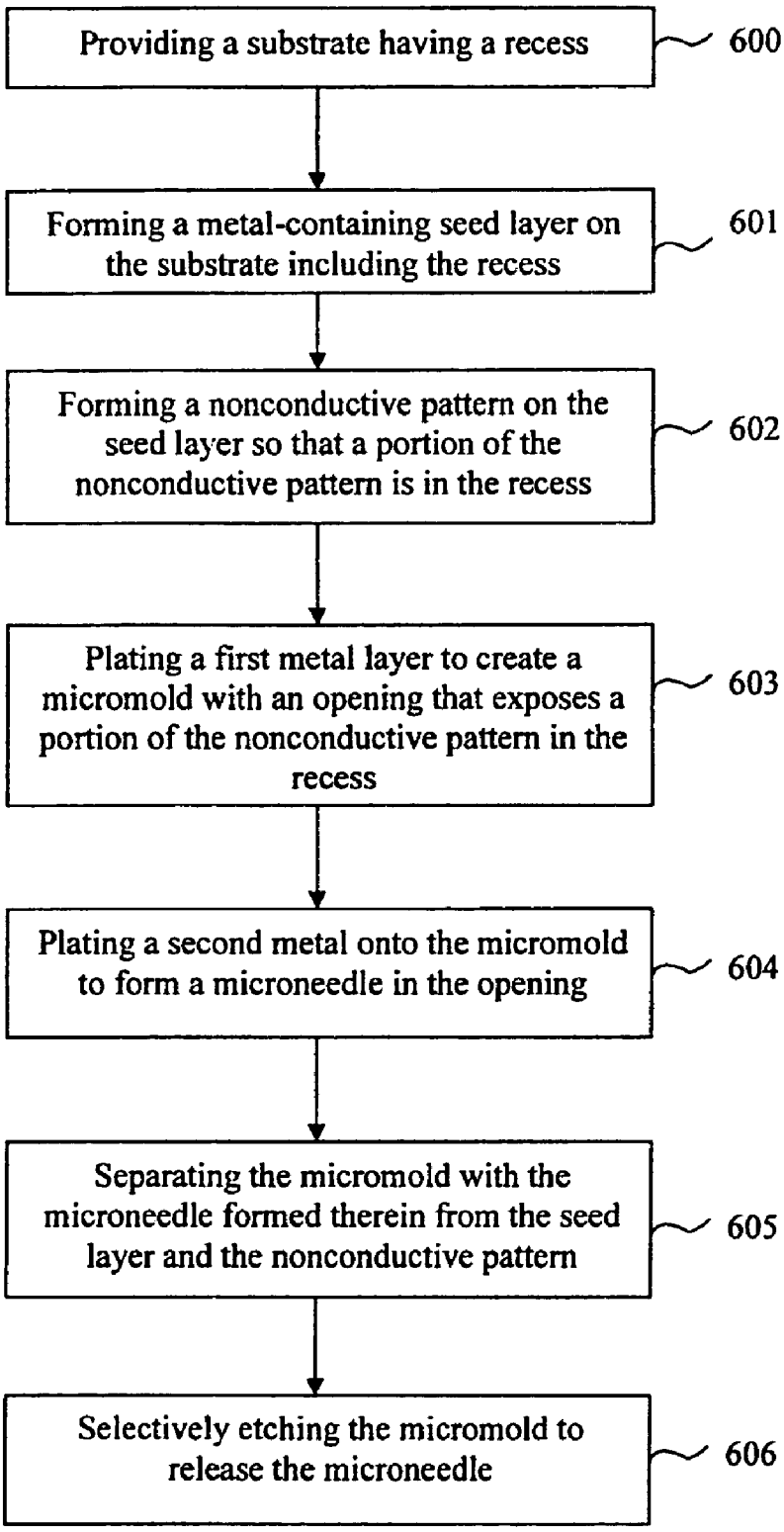
FIG. 6 is a flow chart illustrating a method for fabricating a microneedle with a sharp tip in accordance with a fourth embodiment of the present invention.

FIG. 6 is a flow chart illustrating the processing sequence for fabricating a microneedle with a sharp tip in accordance with a fourth embodiment of the present invention. In this embodiment, a substrate having a recess in the top surface is provided at step 600. A metal-containing seed layer is formed on the top surface at step 601. A nonconductive pattern is formed on the seed layer at step 602 so that a portion of the nonconductive pattern is in the recess. At step 603, a first metal layer is plated on the seed layer and over the edge of the nonconductive pattern to create a micromold with an opening. Next, at step 604, a second metal is plated onto the micromold to form a microneedle in the opening. The micromold together with the microneedle formed therein are separated from the seed layer and the nonconductive pattern at step 605. The micromold is then selectively etched to release the microneedle at step 606.

Figure 7A:
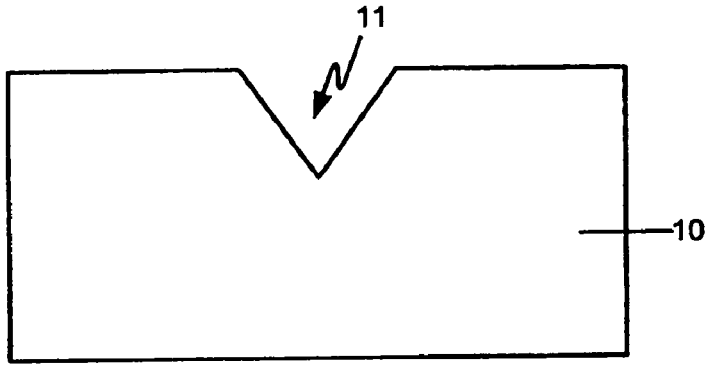
FIGS. 7A–7F show cross-sectional views illustrating the method steps of FIG. 6.

FIGS. 7A–7F show the cross-sectional views illustrating the method steps of FIG. 6. Referring to FIG. 7A, the starting structure is a silicon substrate 10 with a recess 11, which defines the shape of the microneedle's tip to be formed. As examples, the recess 11 may be an inverted pyramidal recess or cone-shaped recess. In an embodiment, the recess 11 is an etched pit formed by anisotropic wet etching using a solution containing tetramethyl ammonium. It will be understood by one skilled in the art that other techniques for forming a recess are possible.

Figure 7B:
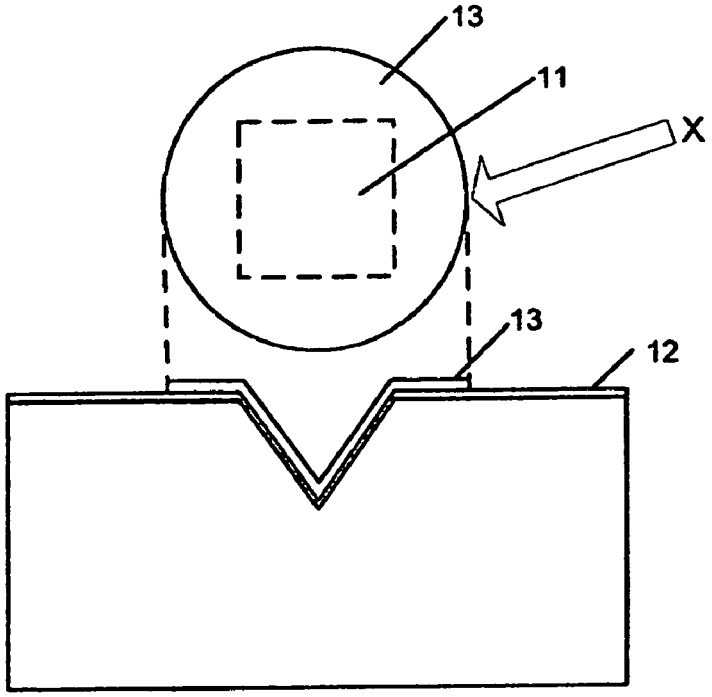
Figure 7C:
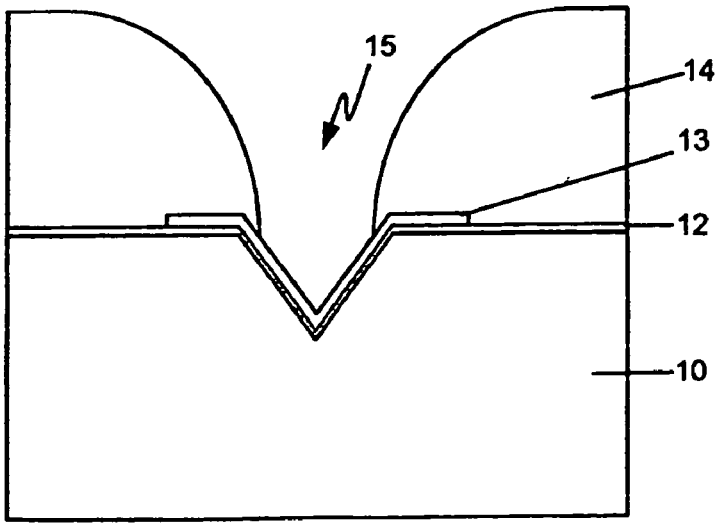

Referring to FIG. 7B, a tri-level seed layer 12 of tantalum-gold-tantalum is sputtered onto the silicon substrate 10 and a SiC pattern 13 is subsequently formed on top of seed layer 12. The SiC pattern 13 is formed by depositing a layer of SiC over the tantalum seed layer 12 followed by masking and etching. The SiC pattern 13 overlies the recess 11 as illustrated by the top view X in FIG. 7B. Next, nickel is electroplated onto the tantalum-gold-tantalum seed layer 12 and over the edge of the SiC pattern 13 to form a micromold 14 with an opening 15 that is vertically aligned with the recess 11 as shown in FIG. 7C.

In the embodiment of FIG. 7B, the SiC pattern 13 is circular in shape, which shape gives rise to a convergent opening with circular cross section. It will be understood by one skilled in the art that other shapes are possible for the nonconductive pattern 13.

Figure 7D:
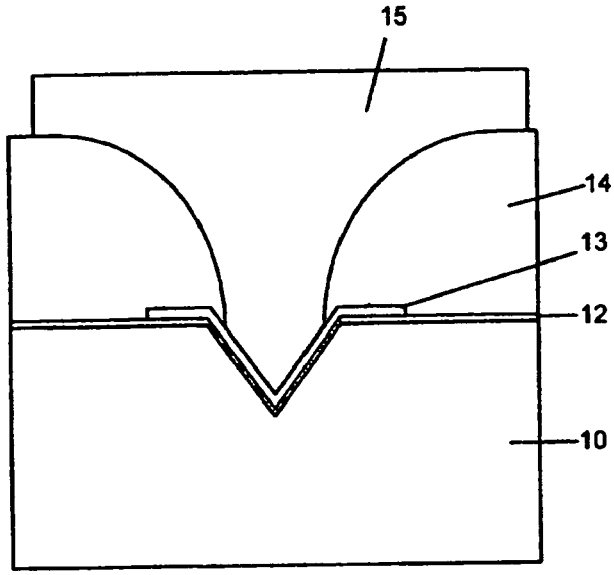
Figure 7E:
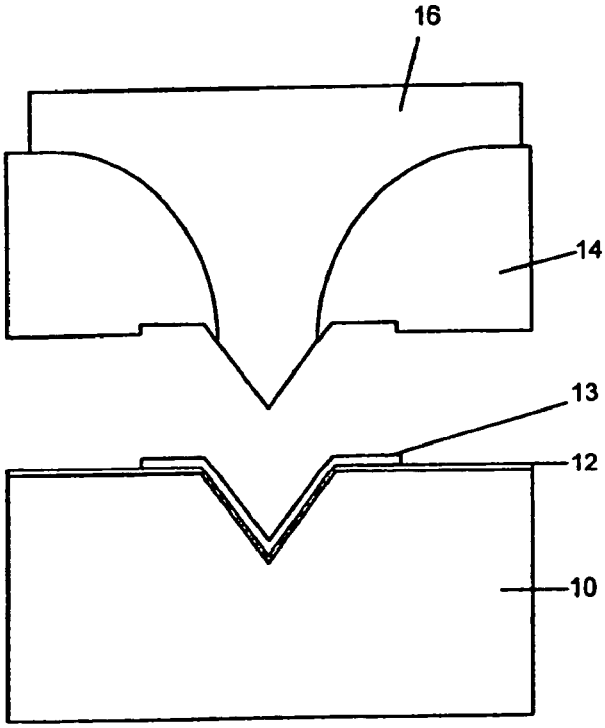
Figure 7F:
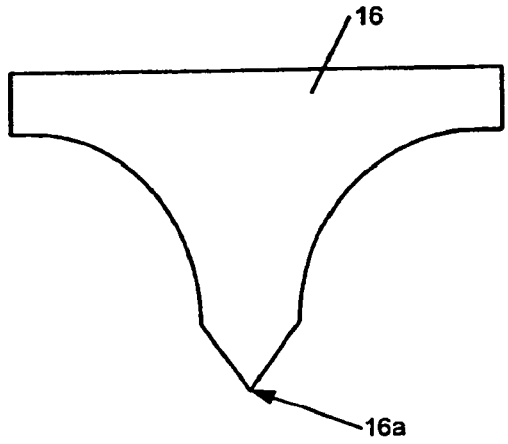

Referring to FIG. 7D, palladium is electroplated onto the micromold 14 to form a solid microneedle 16 in the opening 15. Referring to FIG. 7E, the micromold 14 together with the microneedle 16 are separated from the tantalum seed layer 12 and the SiC pattern 13, e.g. by peeling. The nickel micromold 14 is then selectively etched away, e.g. using a solution of nitric acid and hydrogen peroxide, to release the microneedle 16 as shown in FIG. 7F. The microneedle 16 has a sharp, pointed tip 16*a*.

Figure 8:
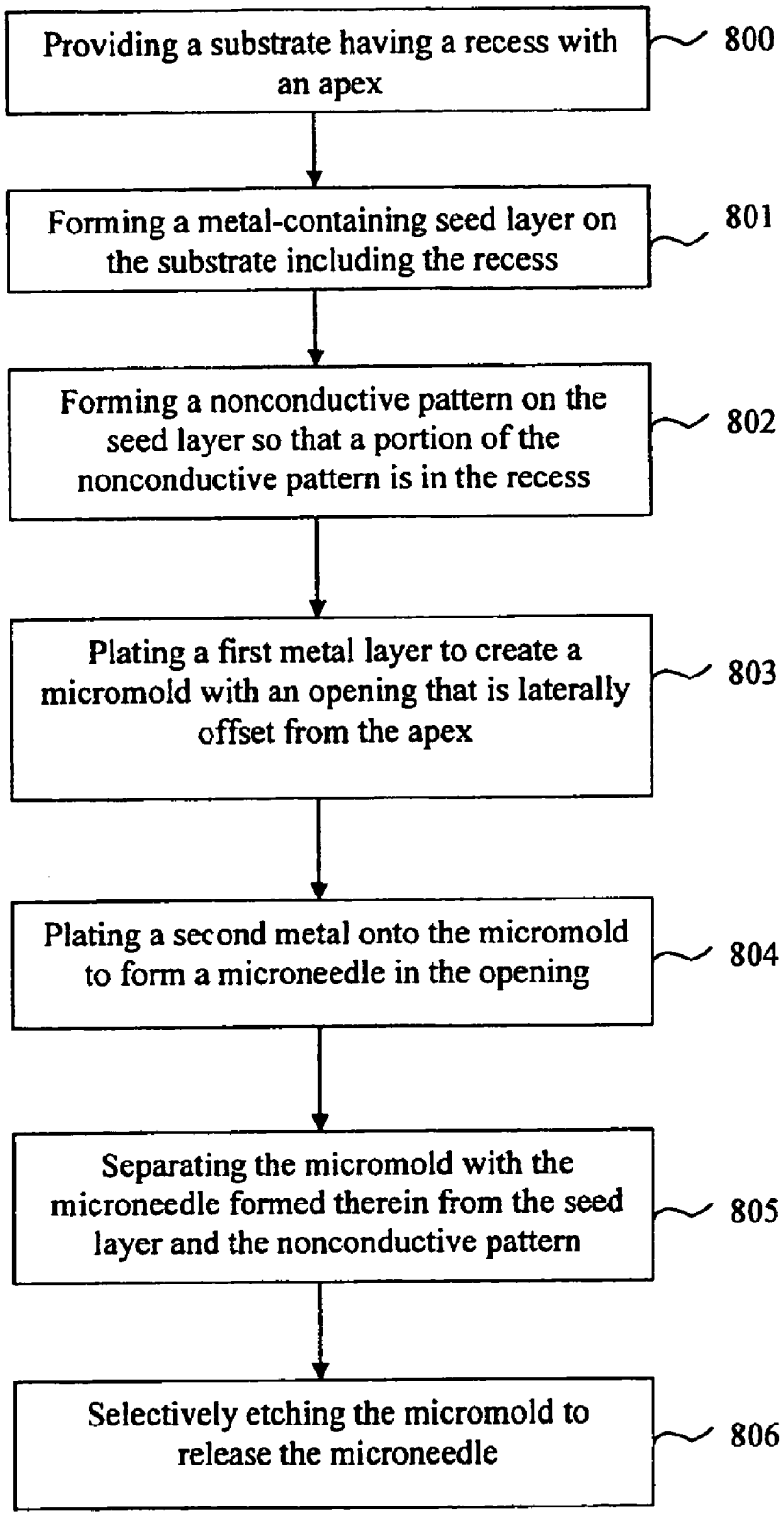
FIG. 8 is a flow chart illustrating a method for fabricating a microneedle with a slanted tip in accordance with a fifth embodiment of the present invention.

FIG. 8 is a flow chart illustrating the processing sequence for fabricating a microneedle with a slanted sharp tip in accordance with a fifth embodiment of the present invention. In this embodiment, a substrate having a recess with an apex in the top surface is provided at step 800. A metal-containing seed layer is formed on the top surface at step 801. A nonconductive pattern is formed on the seed layer at step 802 so that a portion of the nonconductive pattern is in the recess. At step 803, a first metal layer is plated on the seed layer and over the edge of the nonconductive pattern to create a micromold with an opening that is laterally offset from the apex. Next, at step 804, a second metal is plated onto the micromold to form a microneedle in the opening. The micromold together with the microneedle formed therein are separated from the seed layer and the nonconductive pattern at step 805. The micromold is then selectively etched to release the microneedle at step 806.

Figure 9A:
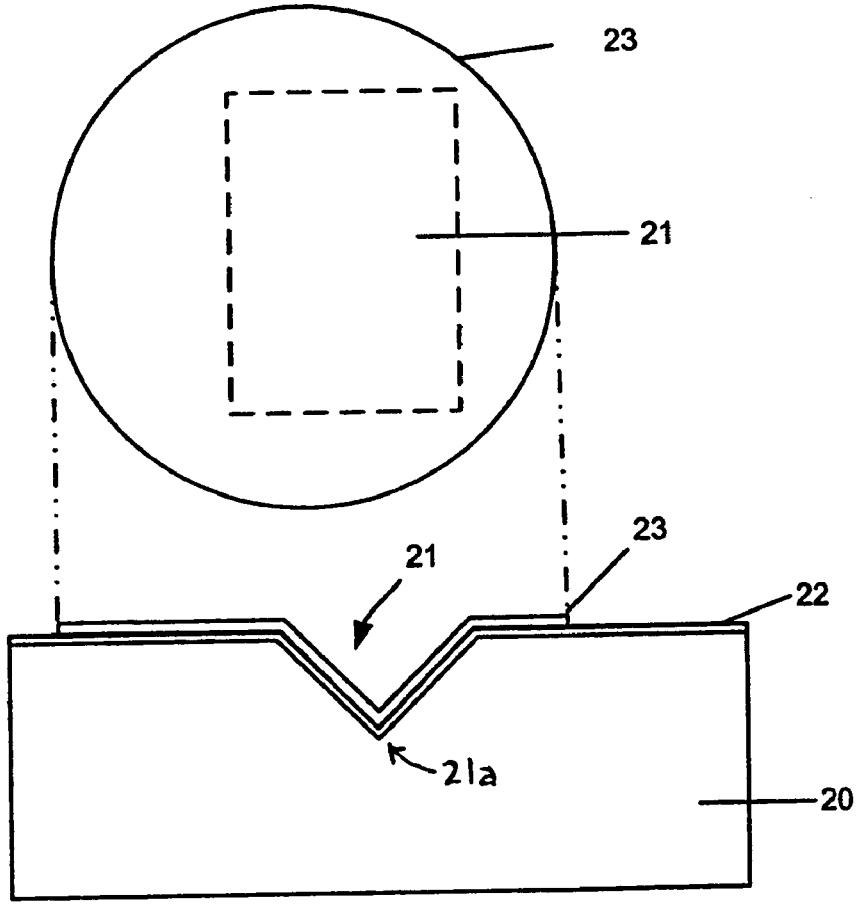
FIGS. 9A–9E show cross-sectional views illustrating the method steps of FIG. 8.
Figure 9B:
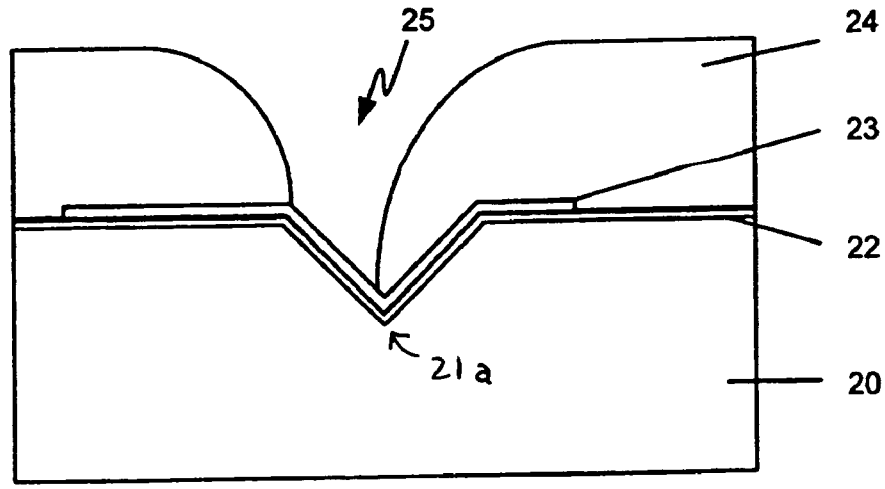
Figure 9C:
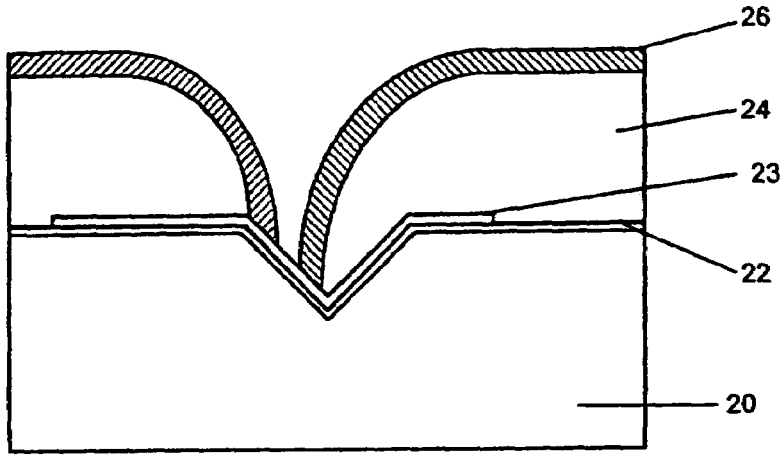
Figure 9D:
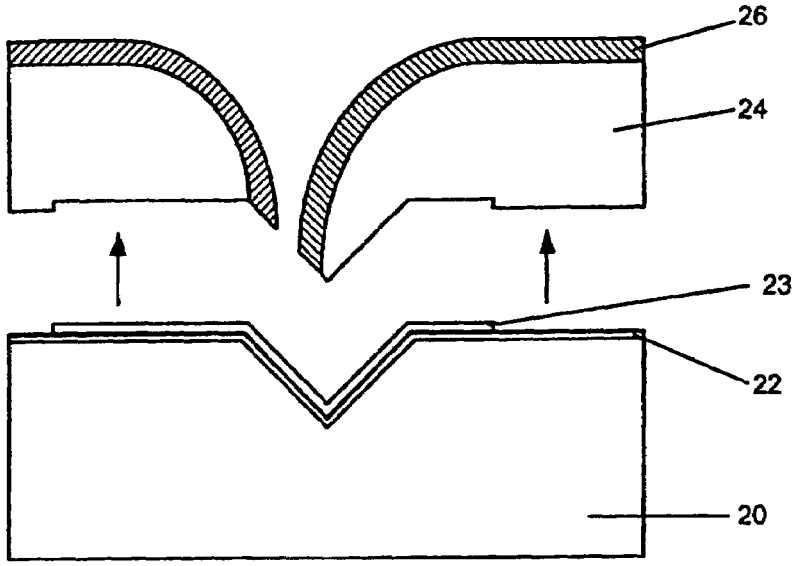
Figure 9E:
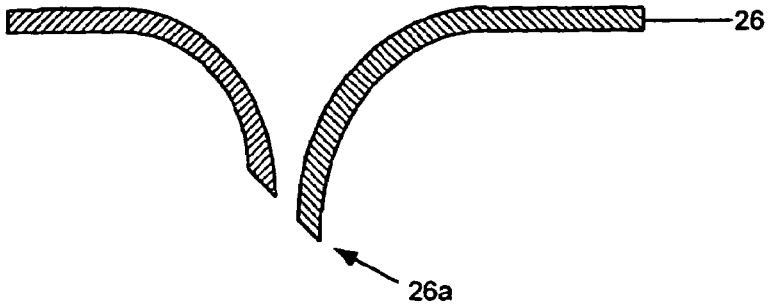

Referring to FIG. 9A, the starting structure is a reusable structure composed of a silicon substrate 20 with an etched pit 21, a tantalum-gold-tantalum seed layer 22, and a SiC pattern 23. The SiC pattern 23 is asymmetrically aligned relative to the apex 21*a* of the etched pit 21. Referring to FIG. 9B, nickel is electroplated onto the tantalum-gold-tantalum seed layer 22 and over the edge of the SiC pattern 23 to form a micromold 24. This plating step results in a micromold 24 with an opening 25 that is offset from the apex 21*a* due to the position of the nonconductive pattern 23. Next, silver is plated onto the sidewall surface of the opening 25 to create a hollow microneedle 26 as shown in FIG. 9C. The micromold 24 and microneedle 26 are separated, e.g. by peeling, from the reusable structure as shown in FIG. 9D. The micromold 24 is then selectively etched to release the microneedle 26 as shown in FIG. 9E. The microneedle 26 has a sharp and slanted tip 26*a*. This needle configuration is particularly useful for extraction of biological fluids and delivery of drugs across the skin with minimal invasion.

The microneedles fabricated by the above methods may have the following dimensions: a height in the range from about 2 μm to about 500 μm, a base diameter in the range from about 5 μm to about 1000 μm. For hollow microneedles, the luminal diameter (i.e., the diameter of the opening at the tip) is in the range from about 5 μm to about 150 μm.

All of the above methods can be adapted to form an array of microneedles. In varying embodiments, the method steps are the same as described above except that an array of nonconductive patterns are formed on the seed layer, whereby the subsequent plating will result in a micromold with a plurality of openings instead of just one.

The microneedles fabricated by the above methods may be integrated with a measurement means to provide a fluid sampling and measurement device. Furthermore, the microneedles may be attached to a reservoir chamber that holds drugs to be delivered for therapeutic or diagnostic applications. Alternatively, the microneedles may be coated with a medication to be introduced into a body.

While certain embodiments have been described herein in connection with the drawings, these embodiments are not intended to be exhaustive or limited to the precise form disclosed. Those skilled in the art will appreciate that obvious modifications and variations may be made to the disclosed embodiments without departing from the subject matter and spirit of the invention as defined by the appended claims.

What is claimed is:

1. A method of fabricating a microneedle, said method comprising the steps of:

(a) providing a substrate;

(b) forming a metal-containing seed layer on the top surface of the substrate;

(c) forming a nonconductive pattern on a portion of the seed layer;

(d) plating a first metal layer on the seed layer and over the edge of the nonconductive pattern to create a micromold with an opening that exposes a portion of the nonconductive pattern;

(e) plating a second metal onto the micromold to form a microneedle in the opening;

(f) separating the micromold with the microneedle formed therein from the seed layer and the nonconductive pattern; and (g) selectively etching the micromold to release the microneedle.

2. The method as recited in claim 1, wherein the plating in step (e) is carried out until the second metal fills the opening, thereby forming a solid microneedle.

3. The method as recited in claim 1, wherein the plating in step (e) forms a metal coating on the sidewall surface of the opening, thereby forming a hollow microneedle.

4. The method as recited in claim 1, wherein the separating step (f) is performed by peeling.

5. The method as recited in claim 1, wherein the separating step (f) is performed with the aid of ultrasonic agitation.

6. The method as recited in claim 1, wherein the seed layer is a bilayer comprised of a chrome layer and a stainless steel layer.

7. The method as recited in claim 1, wherein the nonconductive pattern is formed of a material comprising silicon carbide.

8. The method as recited in claim 7, wherein the first metal layer comprises nickel.

9. The method as recited in claim 1, further comprising the steps of re-using the substrate with the seed layer and nonconductive pattern formed thereon and repeating steps (d)–(g) to fabricate another microneedle.

10. A method of fabricating a microneedle, said method comprising the steps of:

(a) providing a substrate;

(b) forming a metal-containing seed layer on the top surface of the substrate;

(c) forming a nonconductive pattern on a portion of the seed layer;

(d) plating a first metal layer on the seed layer and over the edge of the nonconductive pattern to create a micromold with an opening that exposes a portion of the nonconductive pattern;

(e) separating the micromold from the seed layer and the nonconductive pattern, the separated micromold having exposed top and bottom surfaces;

(f) plating a second metal onto the micromold to fill the opening and to coat the exposed top and bottom surfaces of the micromold;

(g) selectively etching the micromold to release the plated second metal, whereby the plated second metal has the configuration of a microneedle structure attached to an excess layer; and (h) separating the microneedle structure from the excess layer.

11. A method of fabricating an array of microneedles, said method comprising the steps of:

(a) providing a substrate;

(b) forming a metal-containing seed layer on the top surface of the substrate;

(c) forming an array of nonconductive patterns on the seed layer;

(d) plating a first metal layer on the seed layer and over the edges of the nonconductive patterns to create a micromold with a plurality of openings, each opening exposing a portion of a corresponding nonconductive pattern;

(e) plating a second metal onto the micromold to form an array of microneedles in the openings;

(f) mechanically separating the micromold with the microneedles formed therein from the seed layer and the nonconductive patterns; and (g) selectively etching the micromold to release the array of microneedles.

12. The method of claim 11, wherein the plating in step (d) is electroplating.

13. The method as recited in claim 11, wherein the separating step (f) is performed by peeling.

14. The method as recited in claim 11, wherein the separating step (f) is performed with the aid of ultrasonic agitation.

15. A method of fabricating a microneedle, said method comprising the steps of:

(a) providing a substrate with a recess in the top surface of the substrate, the recess having an apex;

(b) forming a metal-containing seed layer on the top surface including the recess;

(c) forming a nonconductive pattern on the seed layer so that a portion of the nonconductive pattern is in the recess;

(d) plating a first metal layer on the seed layer and over the edge of the nonconductive pattern to create a micromold with an opening that exposes a portion of the nonconductive pattern in the recess;

(e) plating a second metal onto the micromold to form a microneedle in the opening;

(f) separating the micromold with the microneedle formed therein from the seed layer and the nonconductive pattern; and (g) selectively etching the micromold to release the microneedle.

16. The method as recited in claim 15, wherein the plating in step (e) is carried out until the second metal fills the opening, thereby forming a solid microneedle.

17. The method as recited in claim 15, wherein the plating in step (e) forms a metal coating on the sidewall surface of the opening, thereby forming a hollow microneedle.

18. The method as recited in claim 15, wherein the recess is a pyramidal etched pit which defines the contour of the tip of the microneedle.

19. The method as recited in claim 15, wherein the opening in the micromold is laterally aligned with the apex of the recess.

20. The method as recited in claim 15, wherein the opening in the micromold is vertically aligned with the apex of the recess.

21. The method as recited in claim 15, wherein the etched pit has an apex and the opening in the micromold is laterally offset from the apex.

22. The method as recited in claim 15, wherein the etched pit has an apex and a sloped sidewall, and the opening in the micromold is offset from the apex and exposes a portion of the sloped sidewall, thereby forming a mold for a microneedle with a slanted tip.

23. The method as recited in claim 22, wherein the plating in step (e) forms a metal coating on the sidewall surface of the opening, thereby producing a hollow microneedle with a slanted tip.

* * * * *